US008342139B2

(12) United States Patent
Rockwell

(10) Patent No.: US 8,342,139 B2
(45) Date of Patent: Jan. 1, 2013

(54) IMMERSE RESISTANT RUST INHIBITING WATER HEATER SUPPORT WITH OR WITHOUT LEVELING CAPABILITIES

(76) Inventor: Christopher L Rockwell, Idyllwild, CA (US)

( * ) Notice: Subject to any disclaimer, the term of this patent is extended or adjusted under 35 U.S.C. 154(b) by 991 days.

(21) Appl. No.: 12/349,036

(22) Filed: Jan. 6, 2009

(65) Prior Publication Data

US 2009/0178629 A1 Jul. 16, 2009

Related U.S. Application Data

(60) Provisional application No. 61/010,553, filed on Jan. 10, 2008.

(51) Int. Cl.
*F24H 9/06* (2006.01)

(52) U.S. Cl. ..... 122/19.2; 122/510; 137/312; 126/383.1

(58) Field of Classification Search ..... 122/19.2, 122/494, 510; 248/152, 346.01, 148, 176.1; 126/277, 376.1, 383.1; 137/312; 220/571, 220/567.3, 694.1

See application file for complete search history.

(56) References Cited

U.S. PATENT DOCUMENTS

| | | | | | |
|---|---|---|---|---|---|
| 1,382,495 | A | * | 6/1921 | Fowles | 122/19.2 |
| 3,519,233 | A | | 7/1970 | Logsdon | |
| 4,413,592 | A | * | 11/1983 | Jones | 122/510 |
| 4,765,360 | A | | 8/1988 | Baird | |
| 5,052,582 | A | * | 10/1991 | Hall | 220/571 |
| 5,134,683 | A | | 7/1992 | Powell | |
| 5,180,077 | A | * | 1/1993 | Lewis | 220/592.2 |
| 5,199,676 | A | | 4/1993 | Kowalewski | |
| 5,368,263 | A | * | 11/1994 | Harrison | 248/146 |
| 5,452,739 | A | * | 9/1995 | Mustee et al. | 137/312 |
| 5,645,103 | A | * | 7/1997 | Whittaker | 137/312 |
| 5,685,509 | A | | 11/1997 | Harrison | |
| 5,746,405 | A | * | 5/1998 | Dvorak et al. | 248/146 |
| 5,836,554 | A | | 11/1998 | Lesage | |
| 5,881,762 | A | * | 3/1999 | Janesky | 137/312 |
| D429,802 | S | | 8/2000 | Whyte | |
| 6,135,410 | A | | 10/2000 | Harrison | |
| D434,125 | S | | 11/2000 | Remeyer | |
| D441,855 | S | | 5/2001 | Fine | |
| D452,903 | S | * | 1/2002 | Whitsitt | D23/322 |
| 6,340,143 | B1 | | 1/2002 | McCraney | |
| 6,360,911 | B1 | * | 3/2002 | Arnold | 220/571 |
| 6,637,453 | B2 | * | 10/2003 | Robinson | 137/312 |
| 7,059,575 | B2 | * | 6/2006 | Garton | 248/346.01 |
| 7,222,823 | B2 | * | 5/2007 | Thomas et al. | 244/173.2 |
| 7,726,620 | B1 | * | 6/2010 | Kleespie | 248/346.01 |
| 8,100,140 | B1 | * | 1/2012 | Cantolino | 137/312 |

* cited by examiner

*Primary Examiner* — Gregory A Wilson

(74) *Attorney, Agent, or Firm* — Kirk A. Buhler; Buhler & Associates

(57) ABSTRACT

Improvements in a catch and drain pan for a water heater is disclosed. The improvement includes an immersion resistant water heater support having a fixed or an adjustable leveling capability. The water heater Lifesaver support fits on the water heater support stand/area or inside a catch drain basing to elevate the water heater weight supporting base or metal legs above any standing water. The water heater Lifesaver support is also fabricated to level an uneven water heater to bring the water heater to a vertical orientation. The adjustable water heater support uses a sandwich of two supports in a cam configuration that are indexable in a plurality of finite engagement positions to slightly alter the vertical orientation of the water heater to account for variations and or horizontal orientation of the water heater mounting surface.

18 Claims, 4 Drawing Sheets

IMMERSE RESISTANT RUST INHIBITING WATER HEATER SUPPORT WITH OR WITHOUT LEVELING CAPABILITIES

CROSS REFERENCE TO RELATED APPLICATION

This application claims the benefit of Provisional 61/010,553 filed Jan. 10, 2008 the entire contents of which is hereby expressly incorporated by reference herein.

FIELD OF THE INVENTION

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to improvements in a catch and drain pan for a tank type water heater. More specifically an immersion resistant water heater support having a fixed or an adjustable leveling capability. The water heater support fits under the water heater or inside a catch/drain basing to elevate the water heater or any part of it above any standing water. The water heater stand is also fabricated to level an uneven water heater to bring the water heater to a vertical orientation.

2. Description of Related Art Including Information Disclosed Under 37 CFR 1.97 and 1.98

Most domestic water heaters that utilize a separate catch/drain pan are susceptible to premature rusting and insulation saturation or improper combustion, in the case of a gas water heater, or, possible short circuit, in the case of an electric water heater.

Recent innovations in tank type residential hot water heater installations include seismic strapping and the catch/drain pan. Seismic straps are intended to keep the device upright and connected to its energy and water sources during earthquakes and are code in California. Earthquake-prone California has the most stringent Uniform Plumbing Code seismic requirements. The catch/drain pan is placed under the water heater in case of a leak. The installation of a catch/drain pan is required under the building and construction code in some municipalities around the country and is becoming more popular due to its flood protection benefits.

The typical residential water heater holds 40-50 gallons. When the water heater is full of water it can weigh between 500-600 pounds or a quarter of a ton standing on three metal legs or the tanks protective metal jacket pan. Both of these support systems and the tank itself are susceptible to rust because the legs and or the tanks protective jacket pan are not meant to be immersed.

Earthquakes that are large enough to tip a water heater over are rare, even in California. However, the Uniform Plumbing Code provides for protection against earthquakes without taking into account the fact that residential hot water heaters remain at risk, a more common and perhaps even greater risk is with the catch/drain pan itself.

The water heater catch/drain pan has protected many homes from potential flooding. The protection from flooding is with the catch/drain pan retaining and diverting water. The catch/drain pan can cause a loss of structural integrity to the water heater's support base thereby creating a possible fire hazard and this loss of structural integrity as well as retained water has been the cause of operational malfunctions. Most catch/drains pans can be detrimental to the water heater because the catch/drain pan contains the "flood" in the area of the water heater. The pan may do its job keeping the house dry, but because it is retaining water, the water heater is partially immersed, standing in water on its rust prone legs or jacket pan. Water heaters are often located in closets, attics or crawl spaces and are usually not annually inspected as many manufactures recommend. Many homeowners never check their water heater until either the water is cold or they see water leaking. A water leak can go unnoticed for an extended period allowing the water heaters weight supporting base to remain in a partially immersed state for an indefinite amount of time.

All tank type water heaters need to be installed in an upright, plumb position. Most electric water heaters stand on very short attached legs or have no legs at all and rest on the bottom pan of the water heater's protective outer jacket (not to be confused with the catch/drain pan). If there is water in the catch/drain pan, some parts of the water heater will be immersed that are not designed or intended to be wet.

When an electric water heater stands in water, the insulation between the tank and protective metal jacket absorbs and wicks water up the sides of the tank and outer jacket. This water seeping action causes rust to form on the tank and jacket. Since the area that is rusting is mostly out of sight, rusting can continue until the jacket pan and/or legs have disintegrated to something less than design specifications as well as damaging the insulation. There is also the potential for an electrical short circuit and possible fire hazard if the dampness reaches the electrical connections of the lower heating element or control thermostat.

Water heaters can leak for various reasons including water expansion during the heating process causing the temperature and pressure relief valve to purge off excess pressure. Although the temperature and pressure relief valve drainpipe should be directed outside the house or to an alternative drain, this is often not the case with the drainpipe allowing expansion water to flow into the catch/drain pan. Other leaking may occur from associated plumbing servicing the water heater, from porosity holes in welds around ports and seams, from the tank itself due to rusting or manufacturing defects or any other plumbing or leak source that finds its way into the catch/drain pan.

In the related art, catch/drain pans are known. For example, U.S. Pat. No. 5,645,103 issued Jul. 8, 1997 to David Whittaker discloses a water heater catch/drain pan which has leveling capabilities and includes a drainage system that would help reduce rust and immersion. U.S. Pat. No. 4,765,360 issued on Aug. 23, 1988 to Williard J. Baird discloses an elevated drain pan. Both of these drain pans have several drawbacks. First, both of these designs incorporate a floor or vertical drain. This is not always practical for many applications.

Second, in a typical house provisions are not made during the construction of a home for a floor drain in the water heater area. This is especially true in a slab construction house or a house without a crawl space or basement. Third, leveling of the water heater is awkward and usually requires additional parts.

Catch/drain pans are usually fabricated from sheet metal or plastic and include knockouts for the attachment of a drainpipe either on the side or bottom of the pan. While these sheet metal or plastic catch/drain pans are simple and inexpensive, functional and easy to install, they have drawbacks due to their design, they do not allow water to drain completely. In addition, they have no practical way of leveling the water heater, which can be a concern in many installations.

The wall height of a catch/drain pan varies from manufacturer to manufacturer. Pans range in depth from an inch to as many as four inches or more. When a residential water heater leaks into a catch/drain pan, the pan will retain water up to the level of its drainpipe connector before it begins to drain. This retained water can be half an inch deep, or deeper, depending on the height of the drainpipe connector, whether the drain pan is level and the drainpipe remains unobstructed.

Consequently, a need has been observed to provide an apparatus that compliments or works in concert with the water heater catch/drain pans that are manufactured and used today.

BRIEF SUMMARY OF THE INVENTION

It is an object of the present invention to provide an improvement to existing water heater catch/drain pans with an insert that works with an existing catch/drain pan to keep the support base of the water heater from standing in water. The improvement lifts the water heater from the bottom of an existing catch/drain pan to prevent the weight supporting structure from degrading in any water that collects in the existing catch/drain pan.

It is an object of the present invention to be made out of recycled high-density polyethylene to help keep weight to a minimum, strength to a maximum and prevent rusting or corroding. The recycled material reduces the cost of the product without sacrificing the strength, rigidity or longevity.

It is another object of the present invention to be situated between the water heater and the catch/drain pan, raising the water heater sufficiently to prevent the water heaters legs, or weight supporting structure from being at a level below the level of the retained, un-drained water in the catch/drain pan should there be a leak.

It is still another object of the present invention to provide a simple, secure and sturdy way of leveling the water heater should the resting area in the household for the water heater be sloped. The leveling is with the inserts being made as cams that are independently movable to alter the angle and the position of the angle relative to the water heater.

Various objects, features, aspects, and advantages of the present invention will become more apparent from the following detailed description of preferred embodiments of the invention, along with the accompanying drawings in which like numerals represent like components.

DETAILED DESCRIPTION

The water heater support is herein identified as a water heater Lifesaver or more simply as "Lifesaver" and is designed to address the problem of water heater immersion and leveling that are important for proper installation and function. More precisely, the Lifesaver enables the easy installation of a water heater on a strong, firm support above the retained water level in a catch/drain pan in a plumb and level manner. As a result, the Lifesaver greatly reduces the possibility of mechanical malfunctions, premature failure, expensive service calls, and unnecessary replacement and/or property damage.

Figure 1:
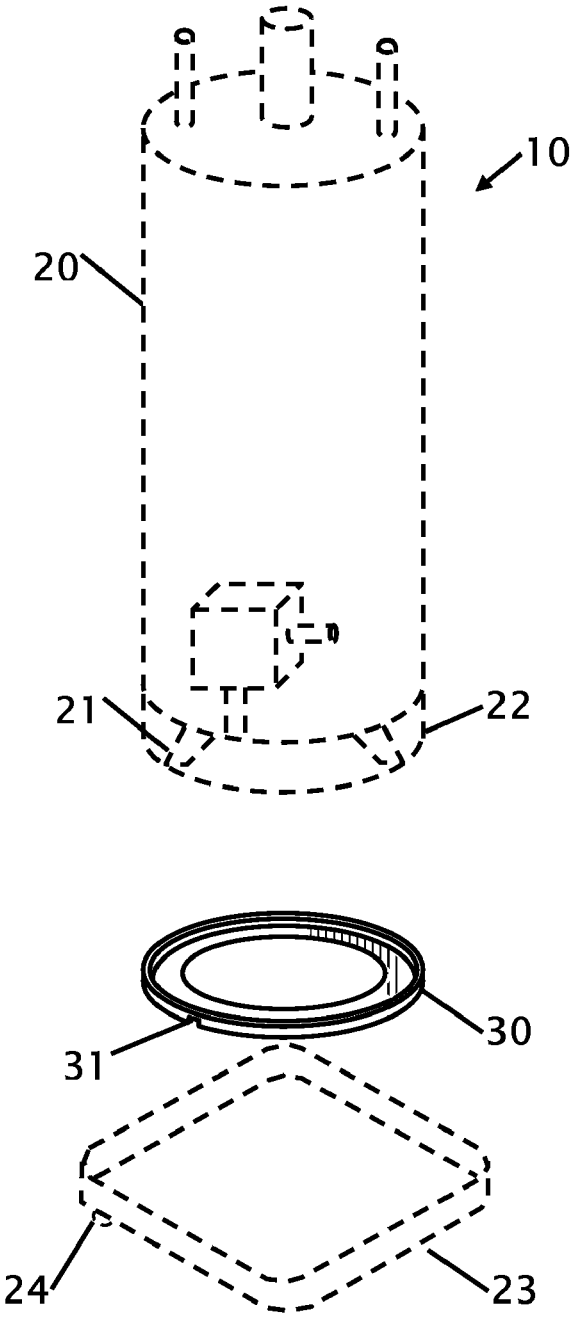
FIG. 1 is an isometric view of the water heater Lifesaver support installed.

FIG. 1 is an exploded isometric view of the water heater Lifesaver support 30 installed. An optional water-collecting basin 23 is shown on the bottom of the exploded view. The collecting basin is optionally installed and works with the water heater Lifesaver support 30. The collecting basin 23 can be fabricated from a number of different materials and in a number of different shapes. The collecting basin 23 has a drain 24 for any collected water to run out the drain 24. Typically, some water will not drain out of the bottom of the collecting basin. The Lifesaver support 30 raises the support base 21 or 22 of the water heater 10 out of the water that can collect in the bottom of the collecting basin 23.

The Lifesaver comes in two versions—flat and angled. The flat Lifesaver is ¾" high at the supporting surface and has a raised edge around its upper circumference to keep the water heater in position on the disc during installation. The flat Lifesaver is all the protection that is needed for installing on a level surface. If the catch/drain pan has a retained water level of more than ¾", regardless of the version, Lifesaver discs can be stacked to exceed the retained water level usually requiring no more than two.

The tank 20 of the water heater 10 rests on the bottom jacket pan 22 or three or more legs 21 or similar support structure. The jacket pan or legs rest on the flat platform of the Lifesaver 30. In the event water leaks into the center of the Lifesaver, the jacket pan or legs are raised above the center of the Lifesaver and any water exits the center of the Lifesaver through the drain 31. The physical shape and characteristics of the Lifesaver are shown and described in more detail with the additional figures shown and described herein.

Figure 2:
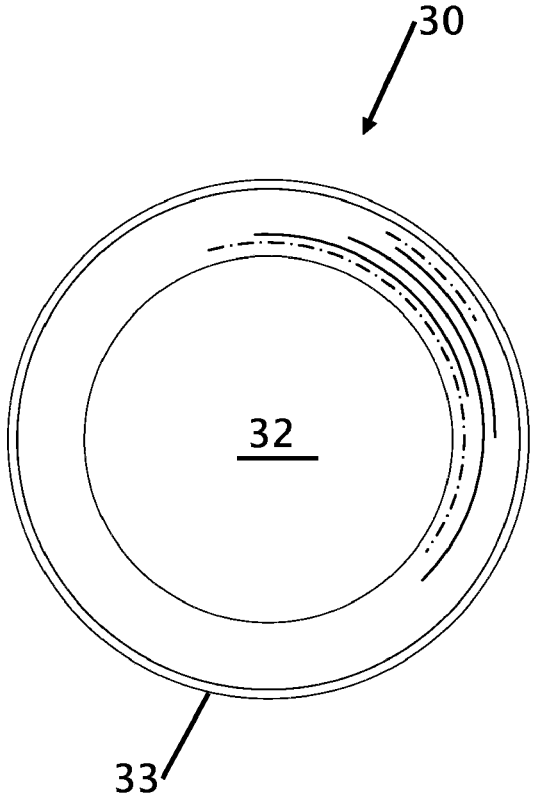
FIG. 2 is a top view of a flat-water heater Lifesaver support.

FIG. 2 is a top view of a flat-water heater Lifesaver support 30. The Water Heater Lifesaver is a disc made of tough, recycled, high-density polyethylene placed under the water heater, between the heater and the catch/drain pan. The Lifesaver 30 is engineered to be as economical as possible and still support the weight of today's large residential water heaters. While this particular material is the preferred material, other materials are contemplated that will provide similar or superior performance. The center of the Lifesaver is open 32 to reduce manufacturing costs and to provide water a path away from the support structure of an installed water heater. It is also contemplated that the center of at least one the Lifesavers has an open center 32 to allow for drainage. A raised outer lip 33 aids in keeping the water heater centered on the disc as well as prevents water from running from the outside of the Lifesaver to the location where the supporting structure is located.

Figure 4:
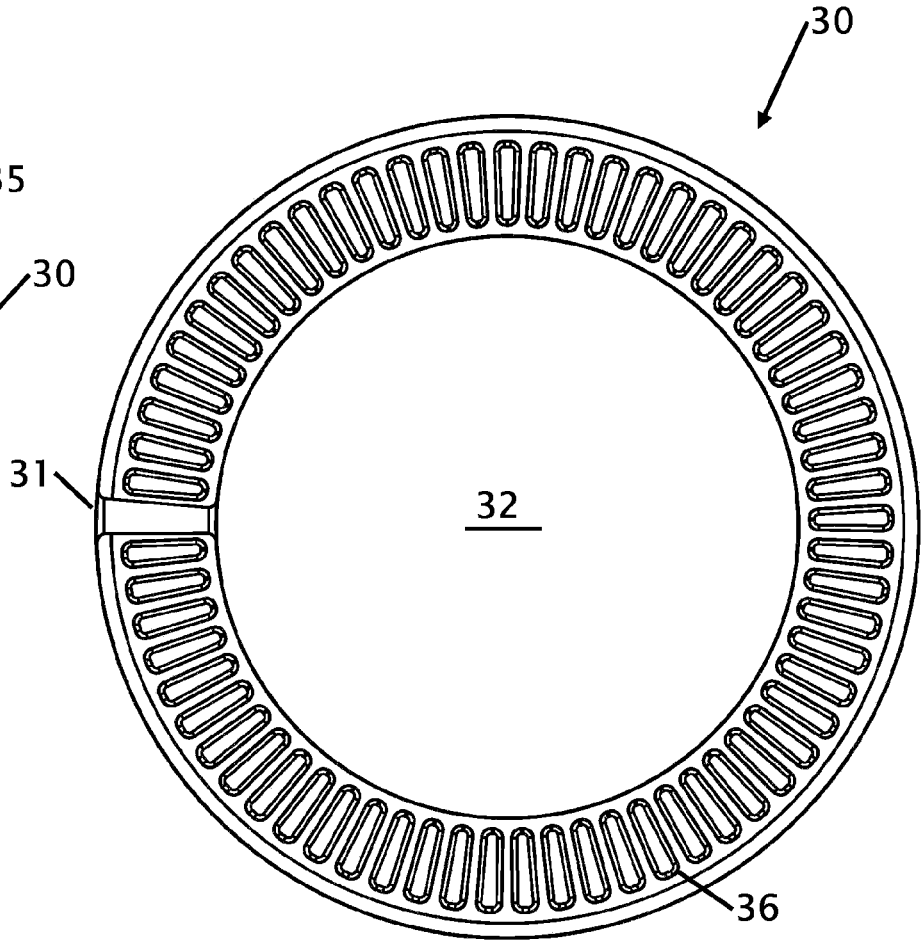
FIG. 4 is a bottom view of a flat-water heater Lifesaver support.

A series of ribs and lightening areas 36, FIG. 4, reduces the weight of the part while maintaining structural strength.

Figure 3:
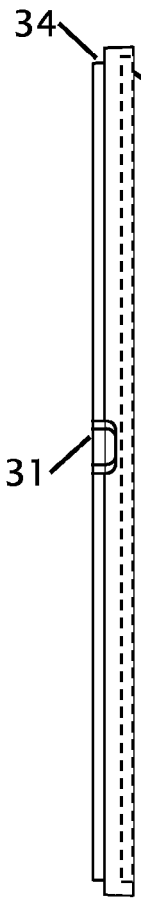
FIG. 3 is a side view of a flat-water heater Lifesaver support.

FIG. 3 is a side view of a flat-water heater Lifesaver support 30 and FIG. 4 is a bottom view of a flat-water heater Lifesaver support 30. This Lifesaver is flat in configuration and does not provide any adjustment for truing the water heater in a vertical orientation. The center of the Lifesaver is open 32 to allow any leaking water to flow away from the support structure of an installed water heater. A drain 31 connects the inside 32 of the Lifesaver to the outside of the Lifesaver to allow water to flow from the inside 32 of the Lifesaver to the outside of the Lifesaver where it is collected in a catch basin or drained away from the water heater. While only one drain 31 is shown, it is contemplated that the design(s) can include multiple drains 31 that are placed around the Lifesaver. A notch 34 provides clearance for the outer lip 35 of the Lifesaver to allow multiple Lifesavers to be stacked.

Figure 5:
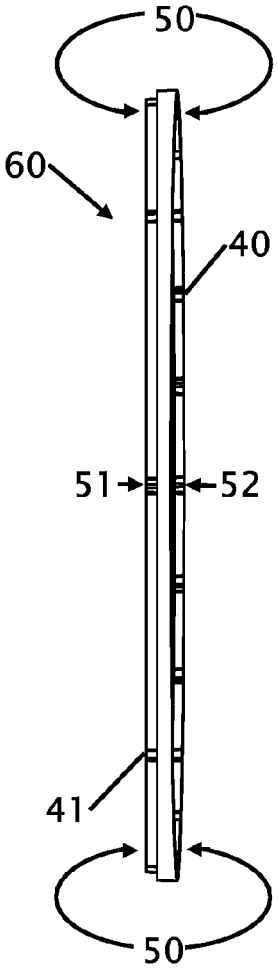
FIG. 5 is a side view of an angled water heater Lifesaver support.
Figure 6:
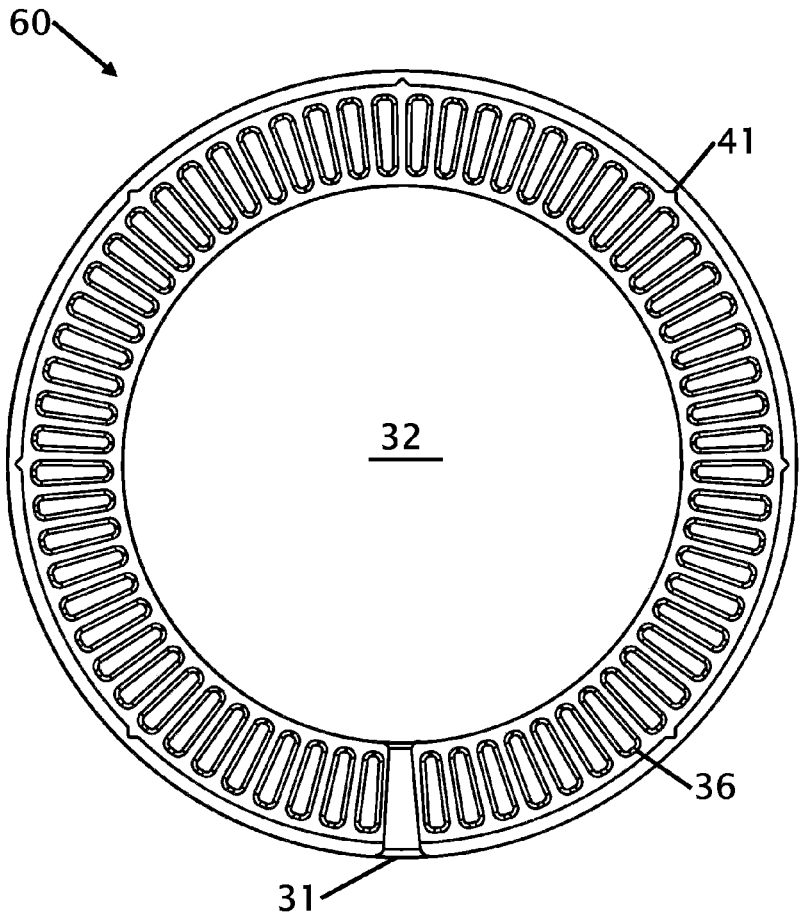
FIG. 6 is a bottom view of an angled water heater Lifesaver support.

FIG. 5 is a side view of an angled water heater Lifesaver 60 support. FIG. 6 is a bottom view of an angled water heater Lifesaver support 60. This configuration of the Lifesaver allows the Lifesaver to be adjustable for use on a non-level; sloping surface where two angled Lifesavers are stacked together. When the upper disc is rotated in relation to the lower disc, the angle of the upper disc changes. At the upper and lower circumference edge of each disc are clocking points 40 and 41 every fifteen degrees that interlock with the disc's counterpart. This configuration allows an angle change from level up to one-inch slope at fifteen-degree increments within the diameter of the disc. If the installer needs to rotate the water heater on the disc stack for proper positioning, with the discs interlocked, the discs will not rotate in relation to each other keeping the preset level setting of the upper disc intact. Disc diameters vary corresponding to different water heater footprint diameters. Using the Lifesaver in conjunction with the catch/drain pan and seismic strapping the installer can be assured of the best possible installation. The angled Lifesaver units also have an open center portion 32 to allow water to drain away from the support structure of a water heater and a drain 31 that allows any water on the inside of the Lifesaver(s) to drain to the outside of the Lifesavers. A series of ribs and lightening areas 36 reduce the weight of the part while maintaining structural strength. A series of raised notches 41 engage into a corresponding set of voids 40 that exist on opposite sides of the angled Lifesavers to allow for angular correction to the upright orientation of an installed water heater. From the side view (FIG. 5) the Lifesaver has one side 51 that is thinner than the other side 52 with the intermediate areas 50 being 90 degrees around from the circumference of the angled disk that is average thickness of areas 51 and 52. In FIG. 6 The drain opening 31 is visible on the bottom side where it extends through the inside and outside diameter of the Lifesaver.

Figure 7:
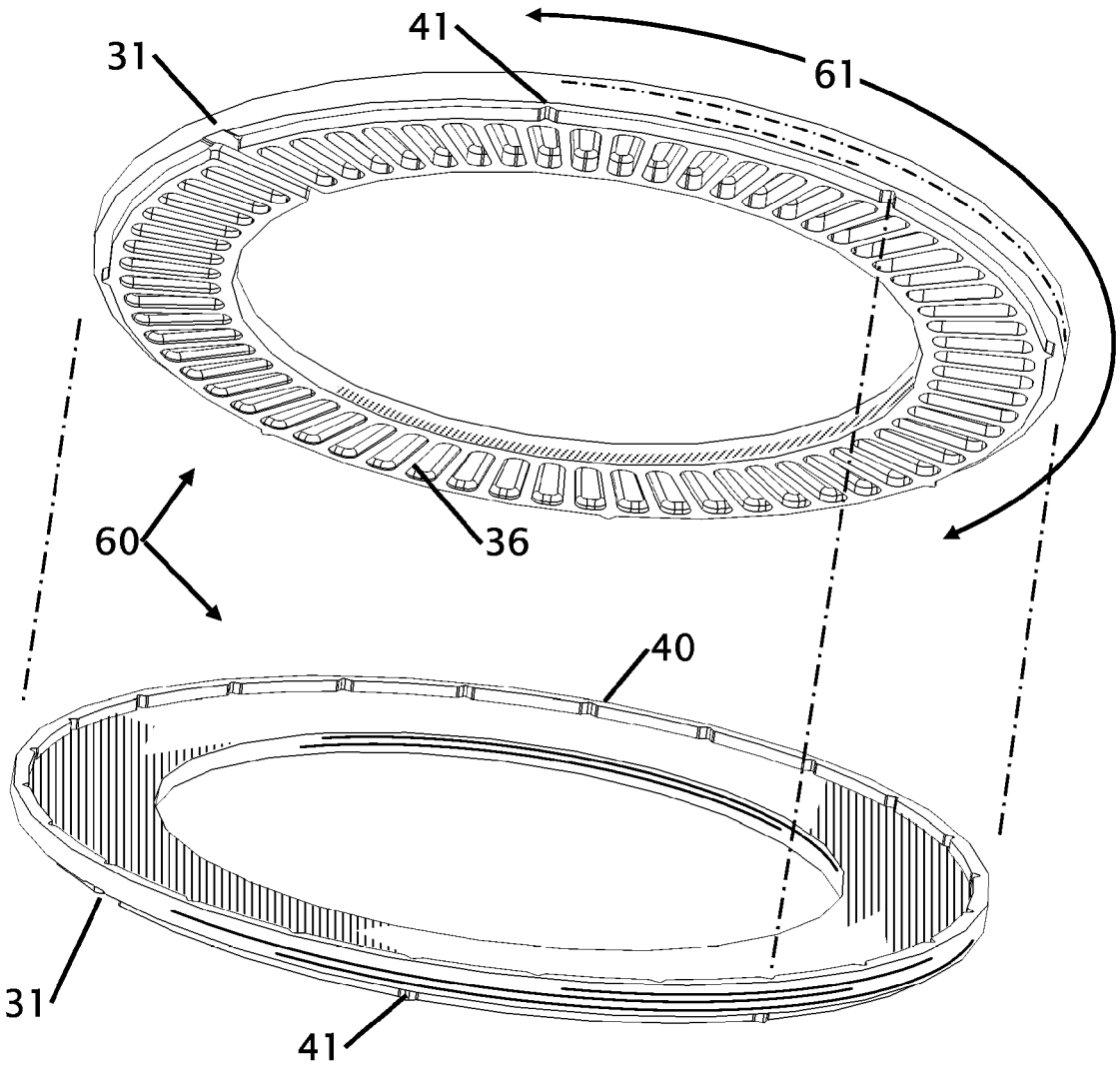
FIG. 7 is an isometric view of two angled water heater Lifesaver supports showing the connection between two nested angled water heater Lifesaver supports.

FIG. 7 is an isometric view of two angled water heater Lifesaver supports showing the connection between two nested angled water heater Lifesaver supports. In this figure the two Lifesavers 60 show how they can be stacked. The drains 31 of the two disks 60 are shown in a similar angular relationship. The series of ribs and lightening areas 36 are shown in the top Lifesaver disk. These ribs reduce the weight of the part while maintaining structural strength. A series of raised notches 41 engage into a corresponding set of voids 40 that exist on opposite sides of the angled Lifesavers to allow for angular correction to the upright orientation of an installed water heater. When the upper Lifesaver is rotated 61 in relation to the lower Lifesaver, the angle of the upper Lifesaver changes. At the upper and lower circumference edge of each Lifesaver are clocking points 40 and 41 at every fifteen degrees that interlock with the disc's counterpart.

Thus, specific embodiments of a water heater Lifesaver have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A water heater support comprising:

at least two nesting dishes wherein a first dish nests inside at least a second dish;

said first and or said at least said second dish has at least one area on a bottom surface outer radius that is thicker than at least one other area on a bottom surface outer radius area on said same dish;

said thicker and thinner area's provides a cam action to allow said dishes to provide angular adjustment to a water heater placed on said water heater support;

at least one of said dishes further includes a raised circumference edge extending at least partially around said dish; and at least one of said dishes includes a drain that allows any fluid that drains within said raised circumference edge to drain outside of said at least two nesting dishes.

2. The water heater support according to claim 1 wherein said raised areas allow support legs of a water heater placed on said raised areas to lift said water heater above said recess areas.

3. The water heater support according to claim 1 wherein said raised areas of said first dish are configured to nest in raised areas of said at least a second dish.

4. The water heater support according to claim 1 wherein said recess areas of said first dish are configured to nest in recess areas of said at least a second dish.

5. The water heater support according to claim 1 wherein said drain exists at the same level as said recess area.

6. The water heater support according to claim 1 wherein said dishes further include clocking points extending from the circumference edge.

7. The water heater support according to claim 6 wherein said clocking provides finite clocking locations for finite angular adjustment of said water heater.

8. The water heater support according to claim 1 wherein multiple disks are stackable.

9. The water heater support according to claim 8 wherein when more than two dishes are utilized additional angular adjustment of said water heater is provided that is not attainable using said two dishes.

10. The water heater support according to claim 1 wherein said clocking points are located at 15 degree increments.

11. The water heater support according to claim 1 wherein said angular adjustment to said water heater allows said water heater to be oriented in a vertical orientation.

12. The water heater support according to claim 1 wherein at least one of said dishes has an open center.

13. The water heater support according to claim 1 wherein at least one of said dished has a closed center.

14. The water heater support according to claim 1 wherein said dishes are made from plastic or metal.

15. The water heater support according to claim 1 wherein said thicker and thinner areas exist on opposite sides of said dish.

16. The water heater support according to claim 1 wherein said drain exists on said thinner area.

17. The water heater support according to claim 1 wherein when said at least two nesting dishes are interlocked they prevent rotation of said first dish within said at least one second dish.

18. The water heater support according to claim 1 wherein said raised circumference edge exists around at least one of said at least two nesting dishes.

* * * * *